US007003991B2

(12) United States Patent
Alizade

(10) Patent No.: US 7,003,991 B2
(45) Date of Patent: Feb. 28, 2006

(54) SECURITY AND LOCKING MECHANISM FOR A DOUBLE DOOR UTILIZED IN A SECURITY SAFE, VAULT OR BUNKER

(76) Inventor: Karl Alizade, 312 Squankum-Yellowbrook Rd., Farmingdale, NJ (US) 07727

( * ) Notice: Subject to any disclaimer, the term of this patent is extended or adjusted under 35 U.S.C. 154(b) by 0 days.

(21) Appl. No.: 10/912,304

(22) Filed: Aug. 6, 2004

(65) Prior Publication Data

US 2005/0284344 A1 Dec. 29, 2005

Related U.S. Application Data

(60) Continuation-in-part of application No. 10/145,402, filed on May 14, 2002, now Pat. No. 6,637,353, which is a continuation-in-part of application No. 09/526,388, filed on Mar. 16, 2000, now Pat. No. 6,273,007, which is a division of application No. 09/271,714, filed on Mar. 18, 1999, now Pat. No. 6,044,776.

(51) Int. Cl.
*E05B 13/00* (2006.01)

(52) U.S. Cl. ..... 70/119; 70/133; 70/210; 70/278.7; 70/283; 70/DIG. 65; 109/59 R; 109/67; 109/74; 292/142; 292/160; 292/172; 292/DIG. 17; 292/DIG. 21

(58) Field of Classification Search ..... 70/118–120, 70/133, 190, 210, 278.1, 279.1, 278.7, 283, 70/DIG. 64, DIG. 65, DIG. 66; 109/59 R, 109/59 T, 67, 74; 292/39, 142, 160, 172, 292/340, DIG. 17, DIG. 21
See application file for complete search history.

(56) References Cited

U.S. PATENT DOCUMENTS

| | | | | | |
|---|---|---|---|---|---|
| 341,728 | A | * | 5/1886 | Caron | 70/118 |
| 1,404,043 | A | * | 1/1922 | Millice | 109/74 |
| 1,577,335 | A | * | 3/1926 | Mariotti | 70/120 |
| 1,594,299 | A | * | 7/1926 | Pence | 70/118 |
| RE16,919 | E | * | 4/1928 | Mariotti | |
| 2,066,705 | A | * | 1/1937 | Posse | 70/118 |
| 2,584,088 | A | * | 1/1952 | Floyd | 292/34 |
| 2,996,322 | A | * | 8/1961 | McClellan | 292/36 |
| 4,266,488 | A | * | 5/1981 | Markham | 109/59 R |

(Continued)

*Primary Examiner*—Lloyd A. Gall
(74) *Attorney, Agent, or Firm*—Clifford G. Frayne

(57) ABSTRACT

A security and locking mechanism for the double door type security safe, vault or bunker wherein the double door can be manufactured by conventional structure or the through use of a plurality of modular panels, the locking and securing mechanism comprising a pair of longitudinal, vertically oriented bolt channels secured to the inner surface of each of the double doors proximate the vertical edges of the double doors, the bolt channels proximate the hinged edge of each door having a plurality of passive locking rods extending there through and extending beyond the hinged edge of the door, the second longitudinal bolt channels on the doors having a plurality of apertures through vertical web members, are secured proximate the seam formed between the double doors, one of the bolt channels being positioned such that it overlaps the seam formed between the two doors, the active locking and securing mechanism comprising a plurality of horizontally oriented throw bolts passing through the longitudinal bolt channels proximate the seam, the plurality of horizontal throw bolts supported by a throw bolt support bar vertically oriented, with at least one of the horizontally oriented throw bolts having a toothed gear formed thereon in communication with a round gear secured to the inner surface of the door, the round gear in communication with a throw bolt wheel located on the outer surface of the door, the throw bolt wheel activatable by a keypad combination member.

8 Claims, 17 Drawing Sheets

U.S. PATENT DOCUMENTS 4,640,052 A * 2/1987 Zebedee et al. ..... 49/383
4,679,415 A * 7/1987 Spratt ..... 70/118
4,688,492 A * 8/1987 Peghetti ..... 109/56
4,714,030 A * 12/1987 Cole ..... 109/61
5,154,461 A * 10/1992 Prescott et al. ..... 292/346
5,197,771 A * 3/1993 Kaup et al. ..... 292/45
5,209,168 A * 5/1993 Chapron et al. ..... 109/59 T
5,245,846 A * 9/1993 James ..... 70/118
5,709,111 A * 1/1998 Henao ..... 70/104
6,044,776 A * 4/2000 Alizade ..... 109/78
6,217,087 B1 * 4/2001 Fuller ..... 292/39
6,273,007 B1 * 8/2001 Alizade ..... 109/49.5
6,601,881 B1 * 8/2003 Mandell et al. ..... 292/92
6,637,353 B1 * 10/2003 Alizade ..... 109/78
6,843,084 B1 * 1/2005 Porter ..... 70/208

* cited by examiner

SECURITY AND LOCKING MECHANISM FOR A DOUBLE DOOR UTILIZED IN A SECURITY SAFE, VAULT OR BUNKER

RELATED APPLICATIONS

This is a continuation-in-part application of U.S. patent application Ser. No. 10/145,402, filed May 14, 2002, U.S. Pat. No. 6,637,353, which is a continuation-in-part application of U.S. patent application Ser. No. 09/526,388, filed Mar. 16, 2000, now U.S. Pat. No. 6,273,007, issued Aug. 14, 2001, which was a divisional application of U.S. patent application Ser. No. 09/271,714, filed Mar. 18, 1999, now U.S. Pat. No. 6,044,776, issued Apr. 4, 2000. The entire disclosures of these related applications are expressly incorporated herein by reference.

BACKGROUND OF THE INVENTION

1. Field of the Invention

The present invention relates generally to security and locking mechanism for the double door type security safe, vault or bunker wherein the door is constructed by conventional means or by modular panels, the security and locking mechanism utilizing a plurality of horizontal throw bolts and bolt channels to effectuate the sealing and locking of the double door.

2. Description of the Prior Art

Security safes and vaults are used for a wide variety of protection. Security safes and vaults can be room size as in the case with many bank safes or vaults and can vary in size down to a wall safe utilized in homes and offices. The sizes and scales of such safes and vaults can vary widely between these two extremes. Applicant is the holder of a series of patents, U.S. Pat. No. 6,044,776 and a divisional and continuation-in-part applications which have matured into patents set forth above there from for modular safes which would typically be utilized for all sizes of the safe-vault continuum. Applicant's module safes allow the safes or vaults of any size to be assembled in situ and still provide superior security and integrity and weight to the typical smaller safes utilized heretofore which could be easily breached or in many instances completely removed from the premises for being breached.

In order to increase the security of safes and vaults, efforts have been made to design modular safes which can be moved piece by piece to a location where it will be used and then assembled. The modular style safe allows for ease of transportation, but prevents such transportation once assembled. It also provides a higher degree of security than other small application safes which, in some instances, can be carried away from the location.

Applicant has further developed the modular concept of safe or vault to include the ability to expand the safe or vault to a larger size utilizing the modular concept which would allow for an individual or entity having a safe or vault already installed of one particular size to be able to expand that safe or vault in situ, by utilizing additional modular panels and security devices such that the size of the safe or vault could be expanded in a geometric progression.

With Applicant's module and expandability characteristics, the time, expense and labor of moving and installing a safe or vault are obviated. Applicant's panels are limited to a weight of 200 pounds per panel and can allow for the installation and construction of a safe or vault without a third parties knowledge that a safe or vault has been installed. Still further, the modularity and expandability characteristics allow for the expansion of an existing safe or vault constructed of Applicant's modular panels to be accomplished without third parties knowledge of such expansion or existence of such safe or vault. This concept alone further heightens the security of the safe or vault. Since if no one knows of its existence except for the owner and the installer, no temptation exists to burglarize the safe or vault.

The present invention relates to a security and locking mechanism for a double door, double hinged, security safe vault or bunker wherein the double doors are constructed of either conventional construction or of modular construction as described in Applicant's prior applications and patents. If a security safe, vault or bunker is to be assembled in situ, the locking and security mechanism must be of a size and weight which is easily transportable yet will provide the necessary security.

The security and locking mechanism of Applicant's invention is comprised of a mechanism having a plurality of horizontal throw bolts which provide at least four contact points with vertically disposed bolt channels between the double doors and eliminate the need for vertical throw bolts necessitated by the prior art in which one of the double doors was secured to the second door by a plurality of horizontal interior throw bolts with the second door being secured to the frame of the safe vault or bunker body by a plurality of vertical throw bolts which were releasable only after the horizontal throw bolts of the first door were released and the door opened. Therefore, the opening of a double door, double hinged entry way required a two step process.

Applicant by incorporating modular elements as here after set forth in Applicant's prior applications can construct a double security door of desired height, and width, for varying sized security safes, vaults or bunkers. The security and locking mechanism can be dimensioned for such size door and the components installed in situ in a modular fashion using threaded fasteners.

While the securing or locking mechanism is particularly designed for Applicant's modular elements, it can also have application to a conventional double door, double hinged security safe, vault or bunker door which conventional security safe, vault or bunker and doors would suffer from the concomitant weight prohibitions, transportation and installation assembly difficulties, whereas Applicant's modular security safe, vault and bunker with modular door and security and locking mechanism can be transported to the site as separate elements and be assembled in situ.

Some of the numerous prior art efforts to provide modular safes can be found in the following references which are discussed in detail in Applicant's prior applications which are incorporated herein: Ouellette, U.S. Pat. No. 5,488,914; Nikoden, Jr., U.S. Pat. No. 4,426,935; Sands, et al., U.S. Pat. No. 4,389,948; Sands, et al, G.B. Patent No. 2,081,335; Stone, U.S. Pat. No. 4,388,874; Dippold, et al., U.S. Pat. No. 4,158,338; Simmons, U.S. Pat. No. 470,017; Farrel, U.S. Pat. No. 328,113; Hall, U.S. Pat. No. 115,728; and Hall, U.S. Pat. No. 70,202.

None of these efforts, taken either alone or in combination, teach or suggest all of the benefits and the utility of the present invention.

OBJECTS OF THE INVENTION

It is an object of the present invention to provide a novel security and locking means for a double door security safe vault or bunker.

It is a further object of the present invention to provide for a novel security and locking means for a double door security safe, vault or bunker which security safe, vault or bunker is constructed from modular panels.

It is a further object of the present invention to provide for a novel security and locking means for a double door security safe vault or bunker wherein the security safe vault or bunker is constructed of conventional means.

It is a further object of the present invention to provide for a novel security and locking means for a double door security safe, vault or bunker in which the security safe, vault or bunker and the double door are constructed of modular panels easily transported in pieces to a location and assembled at the location.

It is an additional object of the present invention to provide for a novel security and locking means for a double door security safe, vault or bunker constructed of modular panels which would allow for the erection and assembly of a security safe, vault or bunker in locations where it would be impossible to install an entire, premade safe, vault or bunker.

It is a still further object of the present intention to provide for a novel security and locking means for a double door security safe vault or bunker constructed of modular panels which would be difficult, if not impossible, to move after assembly.

It is a further object of the present invention to provide for a novel security and locking means for a double door security safe, vault or bunker, which is secured by horizontal throw bolts and obviates the need for vertical throw bolts.

It is an additional object of the present invention to provide for a novel security and locking means for a double door security safe, vault or bunker of modular design and assembly which is suitable for mass production.

It is a still further object of the present invention to provide for a novel security and locking means for a double door security safe, vault or bunker constructed of modular panels which is inexpensive to manufacture and easy to assembly.

It is still a further object of the present invention to provide for a novel security and locking means for a double door security safe, vault or bunker constructed of modular panels which can have a greater or smaller size by using more or less modular panels.

SUMMARY OF THE INVENTION

A security and locking mechanism for the double door type security safe, vault or bunker wherein the double door can be manufactured by conventional means or the through the use of a plurality of modular panels, the locking and securing means comprising a pair of longitudinal, vertically oriented bolt channels secured to the inner surface of each of the double doors proximate the vertical edges of the double doors, the bolt channels proximate the hinged edge of each door having a plurality of passive locking rods extending there through and extending beyond the hinged edge of the door, the second longitudinal bolt channels on the doors having a plurality of apertures through vertical web members, are secured proximate the seam formed between the double doors, one bolt channel being positioned such that it overlaps the seam formed between the two doors, the active locking and securing mechanism comprising a plurality of horizontally oriented throw bolts passing through the longitudinal bolt channels proximate the seam, the plurality of horizontal throw bolts supported by a throw bolt support bar vertically oriented, with at least one of the horizontally oriented throw bolts having a toothed gear formed thereon in communication with a round gear secured to the inner surface of the door, the round gear in communication with a throw bolt wheel located on the outer surface of the door, the throw bolt wheel activatable by a keypad combination member.

BRIEF DESCRIPTION OF THE DRAWINGS

These and other objects of the present invention will become apparent, particularly when taken in light of the following illustrations. FIGS. 1*a* through 9 are exemplary of the prior art as taught and disclosed in Applicant's prior applications and patents.

FIG. 1*a* is a perspective view of the modular security safe of the present invention shown in an assembled form;

FIG. 2 is a perspective view of the security bolt box for use in assembling the modular safe of the present invention;

FIG. 8 is an end view illustrating two adjacent panels, security bolt box and filler block;

FIG. 9 is a front cross sectional view of a safe with the door removed illustrating the cooperativeness of the panels, filler block and security bolt box;

DETAILED DESCRIPTION OF THE INVENTION

Figure 1A:
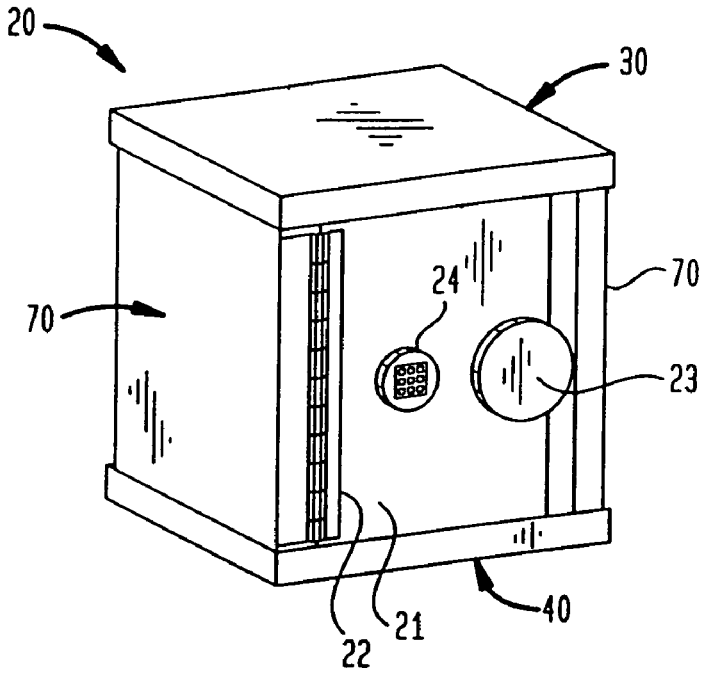
Figure 1B:
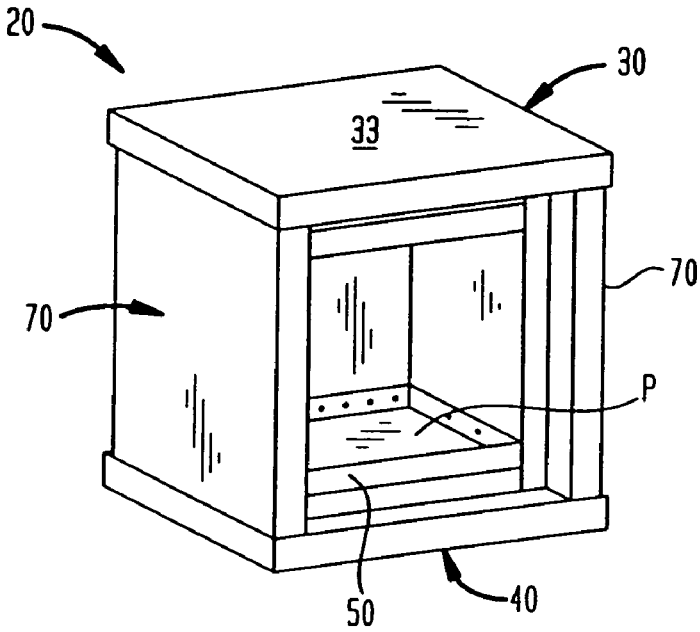
FIG. 1*b* is a perspective view of the apparatus of FIG. 1*a* with the door of the safe removed.
Figure 1C:
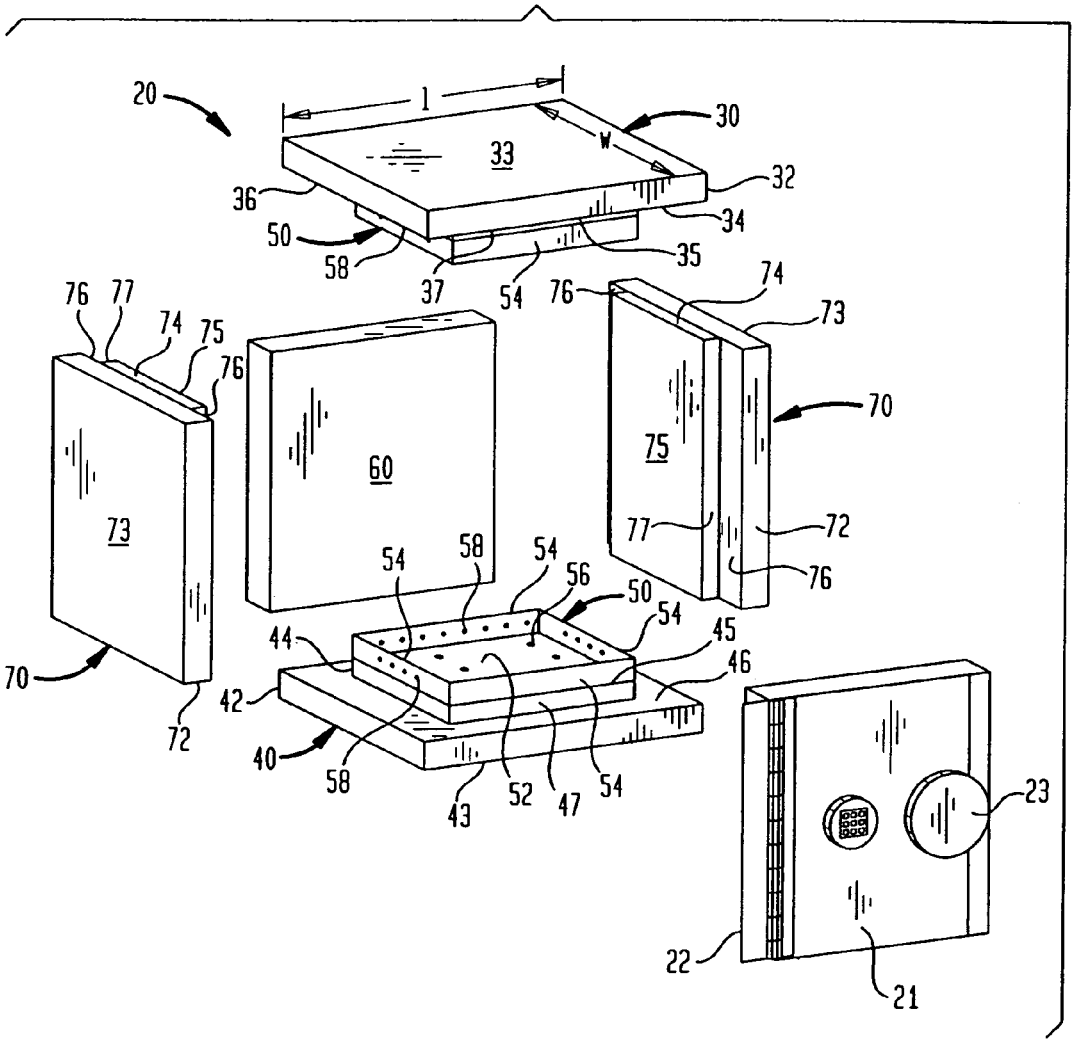
FIG. 1*c* is an exploded perspective view of the apparatus of FIG. 1*a;*

For purposes of continuity, Applicant sets forth a detailed description of Applicant's modular panels and safes as described in Applicant's prior applications. The improved modular security safe with offset security bolt box of the present invention is shown in FIGS. 1*a*, 1*b*, and 1*c*. The safe is generally indicates at 20. The safe 20 comprises a door 21 attached by a hinge 22. The door 21 further includes a handle 23 for opening and closing the door. Combination lock means 24 is also provided in connection with the door 21 of safe 20.

As can be seen in FIG. 1*a* and in more detail in FIGS. 1*b* and 1*c*, the modular safe 20 includes a top panel 30, a bottom panel 40, a back panel 60 and side panels 70. These panels, 30, 40, 60, and 70, the structure of which will be further discussed hereinafter, are interconnected by means of security bolt boxes 50 which attach the panels together to form the safe 20.

Top panel 30 includes an outer portion 32 with an outer surface 33 and an inner portion 34 with an inner surface 35. The inner portion 34 is generally smaller than the outer portion 32 in terms of length l and width w. A rabbet face 36 is created on the outer portion 32. The rabbet face 36, in connection with the perimeter 37 of the inner portion 34, forms a step between the inner portion 34 and the outer portion 32.

Similarly, the bottom panel 40 includes an outer portion 42 with an outer surface 43 and an inner portion 44 with an inner surface 45. The inner portion 44 is generally smaller than the outer portion 42 in terms of length l and width w. A rabbet face 46 is created on the outer portion 42. The rabbet face 46, in connection with the perimeter 47 of the inner portion 44, forms a step between the inner portion 44 and the outer portion 42.

Attached to the inner surface 35 of the inner portion 34 of the top panel 30 is a security bolt box generally indicated at 50. Likewise, a security bolt box 50 is attached to the inner surface 45 of the inner portion 44 of the bottom panel 40. The security bolt box 50 includes a bottom face 52 and upstanding walls 54 to form a tray-like configuration. The upstanding walls 54 can be interconnected with the bottom face 52 or can be formed through a bending and folding operation that will be hereinafter described. The security bolt box 50 is attached to the inner portion 34 of top panel 30 and inner portion 44 of bottom panel 40 by means of anchor bolts (not shown) which extend through anchor bolt apertures 56 in the security bolt box 50. The security bolt box 50 is also provided with attachment bolt apertures 58 extending about the upstanding walls 54 for receiving attachment bolts (not shown) to attach side panels 70 and back panel 60 with the top and bottom panels 30 and 40 to form the safe.

The back panel 60 is a generally rectangular wall formed with a plurality of bolt apertures along upper and lower edges for interconnecting with the security bolt box 50 by attachment bolts.

Side panels 70 include outer portions 72 and inner portions 74. The outer portion 72 includes an outer surface or facia plate 73, and the inner portion 74 includes an inner surface 75. Like the top panel and bottom panel, the inner portion 74 is stepped in relation to the outer portion 72 creating a rabbet face 76, which extends the length of the side panels, in a direction orthogonal to width W of the top panel 30 and bottom panel 40. However, unlike the top panel 30 and the bottom panel 40 which are stepped down on all four sides, the top and bottom surfaces of the inner portion 74 remain flush with the outer portion 72. Again, upper and lower edges of the inner surfaces 75 of the side panels 70 include apertures for receiving attachment bolts (not shown) that extend through the security bolt boxes 50 to join the side walls 70, back wall 60 and top and bottom panels 30 and 40.

Figure 2:
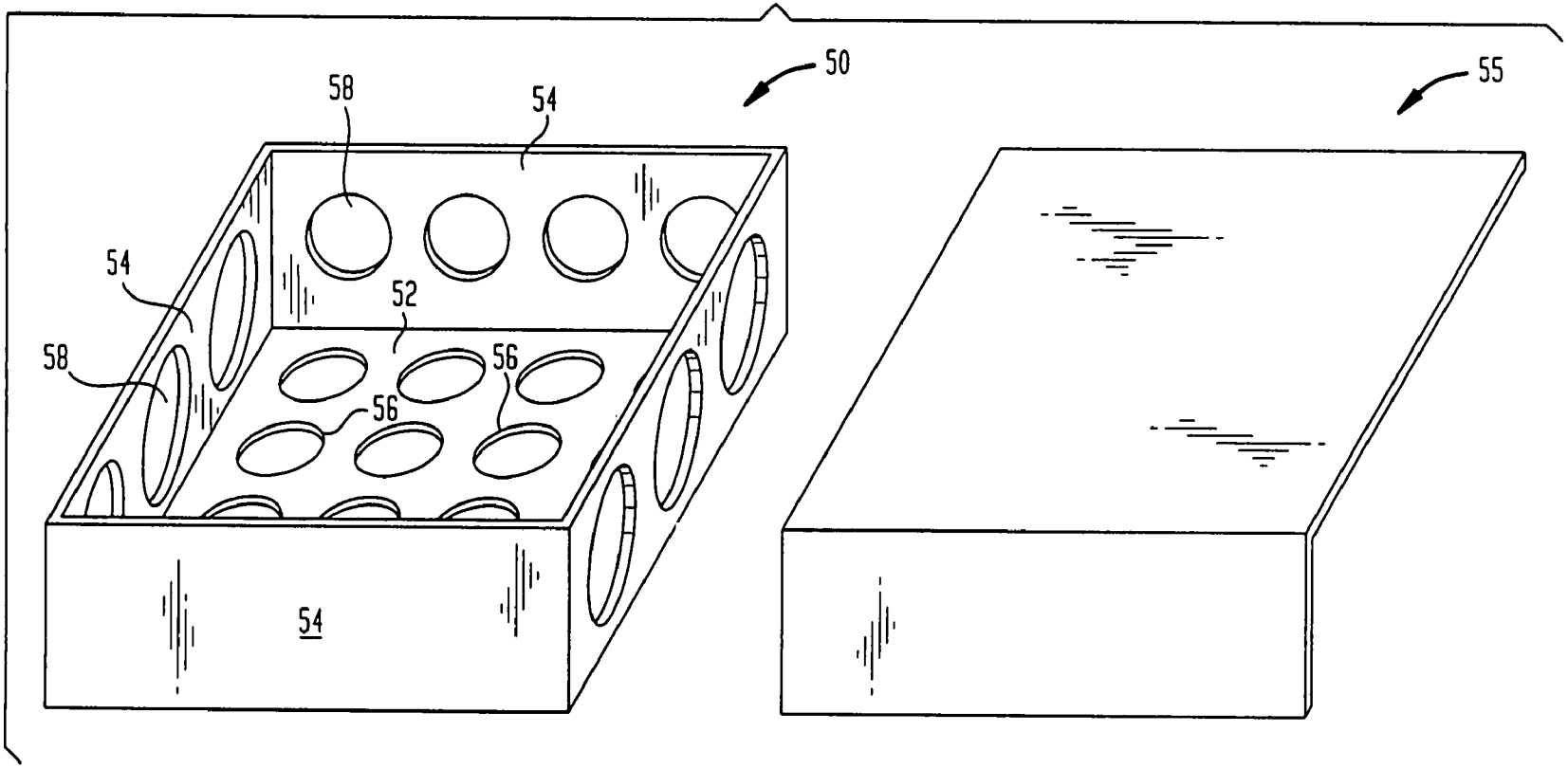

Referring now to FIG. 2, a perspective view of the security bolt box 50 is shown. Again the security bolt box includes a bottom face 52 and upstanding side walls 54. The box can be formed from a single sheet of metal with cut out corners and edges bent up to form the flat piece into a tray. Anchor bolt apertures 56 are punched through the bottom face 52 for attachment of the security box 50 to the inner surfaces 35 and 45 of the inner portions 34 and 44 of top and bottom panels 30 and 40. Attachment bolt apertures 58 are punched through the upstanding walls for attachment of the security box to top panel 30, back panel 60 and side panels 70.

Figure 3A:
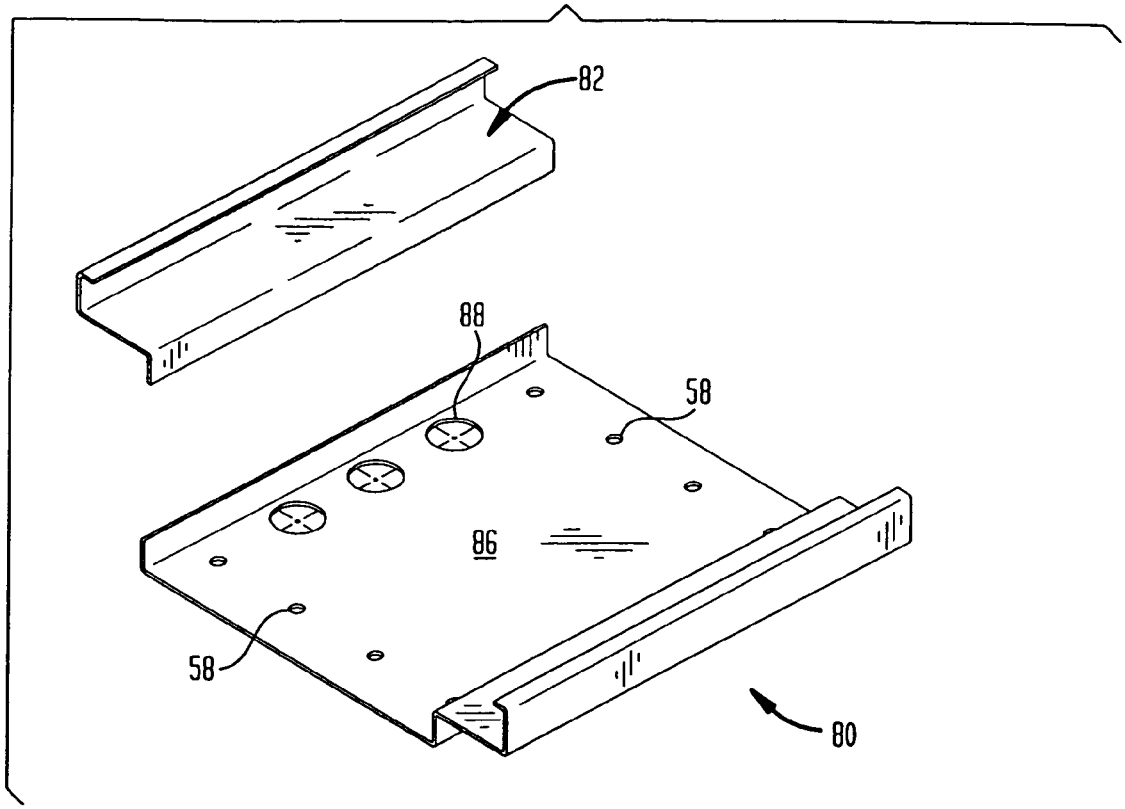
FIG. 3*a* is a perspective view of a side panel shell in a first stage of manufacture.
Figure 3B:
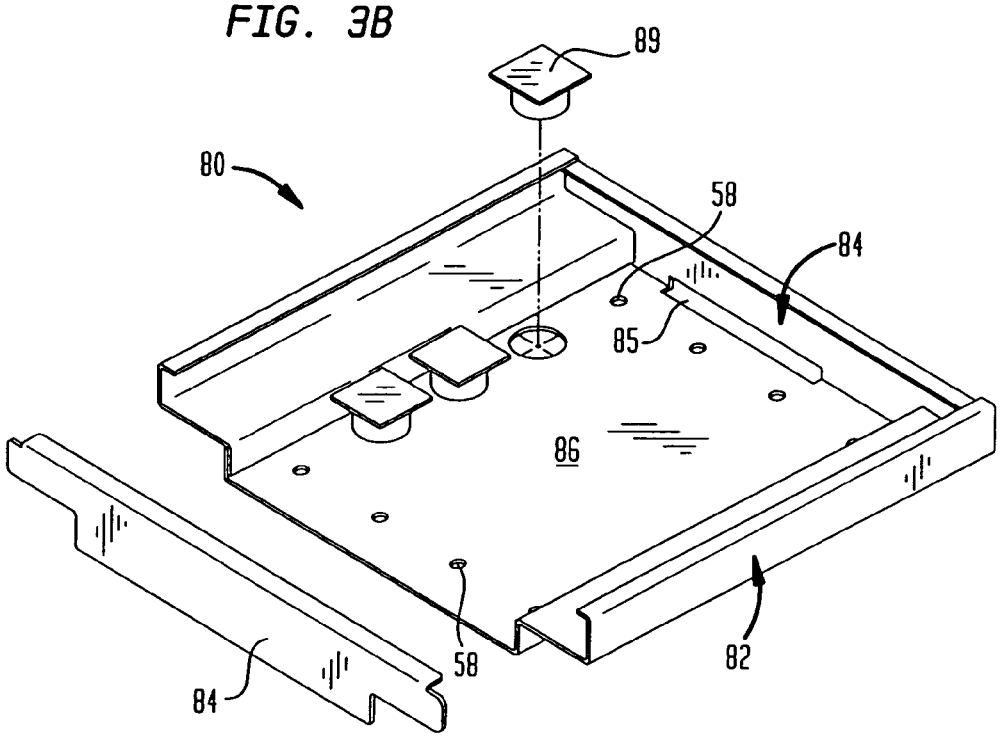
FIG. 3*b* is a perspective view of the side panel shell shown in FIG. 3*a* in a subsequent state of manufacture.

Referring now to FIGS. 3 through 5, the sequence steps in forming the panels is shown. A typical side panel is formed from a flat metal sheet which can be bent along edges thereof to form side walls 82 of side panel sheet 80. Alternatively, the side walls 82 can be separately formed and attached by welding 85 or other means to bottom plate 86. The side panel shell 80 comprises a shell bottom plate 86, and two side walls 82. Also, two shell end walls 84, also typically made of a sheet metal material, and are attached by welding or other means to the bottom shell plate 86 to form the basic side panel shell 80. Prior to forming or attaching the walls to the bottom plate, the shell bottom plate 86 has attachment bolt apertures 58 punched out at both the top and bottom edges thereof. If the side wall will receive lock bolts from the door of the safe, the shell bottom plate 86 is further punched with locking bolt apertures 88 along an edge thereof. These locking bolt apertures are then covered with covers 89 which comprise cylindrical bodies and caps and which define the bolt receiving space during the remaining fabrication steps.

Figure 4A:
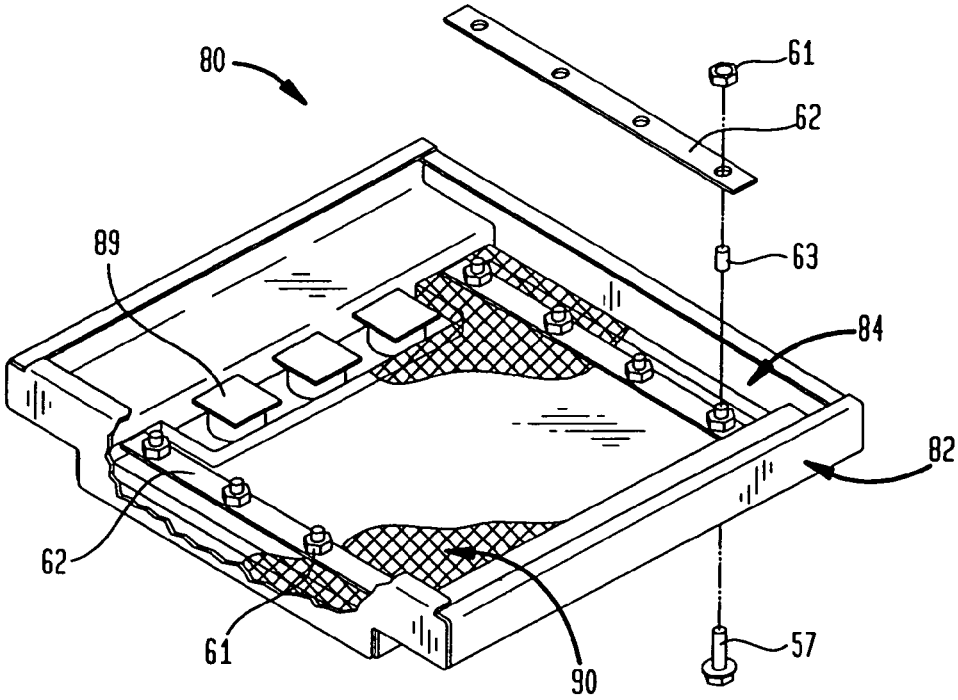
FIG. 4*a* is a perspective view of the side panel shell shown in FIG. 3*b* in a subsequent stage of manufacture with attachment bolts and a first layer of expanded metal.
Figure 4B:
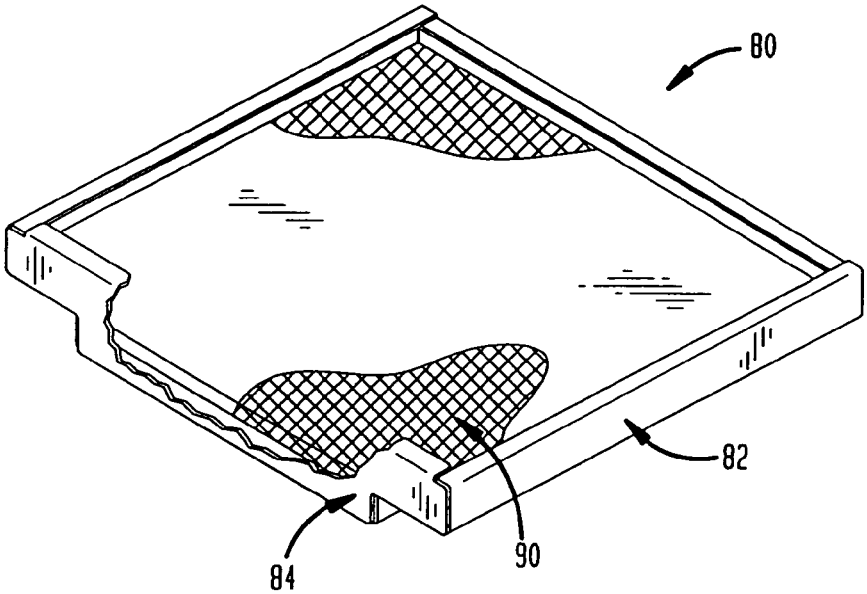
FIG. 4*b* is a perspective view of the side panel shell of FIG. 4*a* with second layer of expanded metal.

FIGS. 4*a* and 4*b* show the next steps involved in the construction of the side panel. First, attachment bolts 57 are fitted through the attachment bolt apertures 58. The attachment bolts 57 are then fitted with attachment plate spaced 63. Thereafter a layer of expanded metal 90 is placed within the shell and covers the entire shell bottom plate 86 with the exception of the space occupied by the locking bolt aperture covers 89. Next, the attachment bolts 57 are fitted through an attachment bolt plate 62 and locked into place by attachment nuts 61. Then, a second layer of expanded metal 90 is positioned with the shell over the first layer.

Figure 5A:
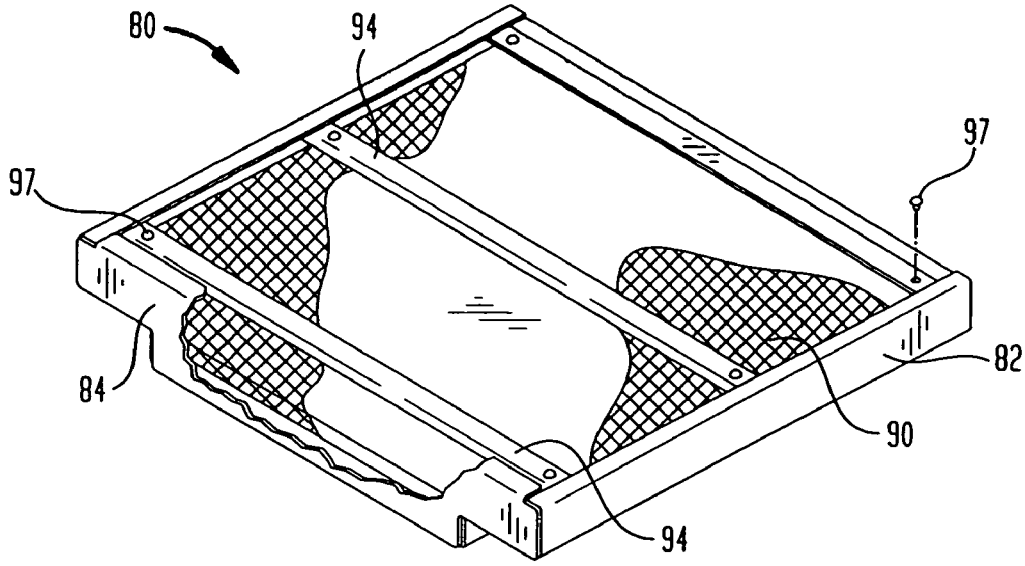
FIG. 5*a* is a perspective view of the side panel shell of FIG. 4*b* with support brackets prior to the final pouring of concrete filler.
Figure 5B:
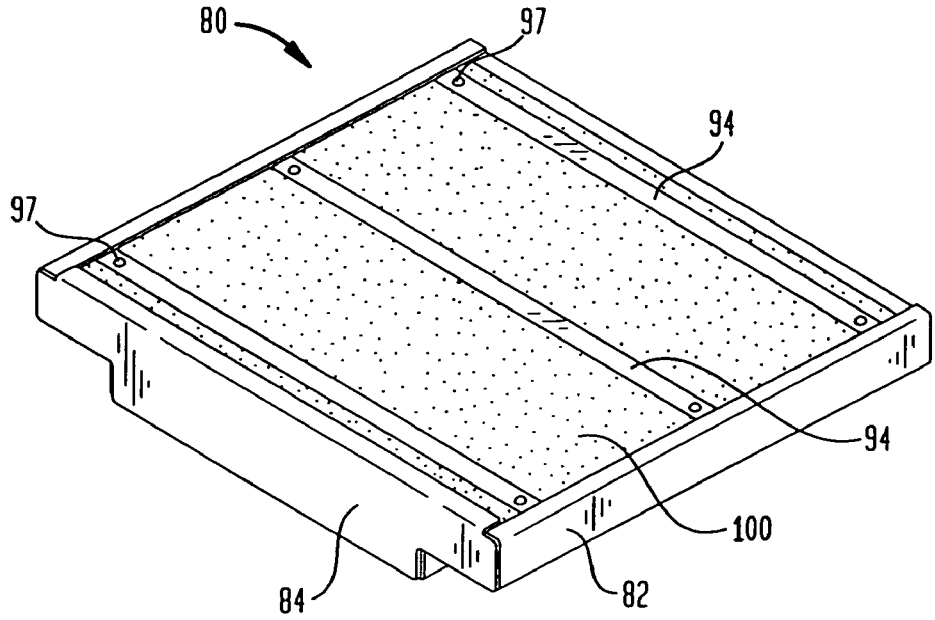
FIG. 5*b* is a perspective view of the side panel shell of FIG. 5*a* complete with the last layer of concrete filler.

FIGS. 5*a* and 5*b* detail the final steps of construction. The second layer of expanded metal 90 is secured in place by support brackets 94 which are held in place by support bolts 97. Then, a single pour of high density concrete 100 is poured into the shell. Then the shell is vibrated to permit the concrete to settle, and the concrete is allowed to set. Importantly, the panel is constructed with the smaller, inner portion down so that only one pour is necessary. At this point all that is required is the attachment of a cover or fascia plate of any desired material which can be glued or otherwise attached to the exterior of the panel to provide any desired appearance. This step can be performed before or after the construction of the safe.

Construction of the top and bottom panes 30 and 40 follow generally the same method of construction. Likewise, the door 21 is a panel and does not require any special top and bottom filler panels.

It should be noted that the concrete can be formulated in accordance with the requirements of the application. For example, high density concrete can be used for high security application, while ready mix or other more economic concrete mixtures can be used in connection with lower security applications. Further, the other components of the panels, i.e. the expanded metal or reinforcement plates or aluminum or stone can be varied as desired.

After the panels set, the attachment bolts 57 and anchor bolts are removed from the panels. Security bolt boxes 50 are then placed on both the top and bottom panels 30 and 40, and are fixed in place with the anchor bolts which pass through the anchor bolt apertures 56 of the security bolt box 50 and into security anchor bolt apertures at the top and bottom panel 30 and 40 where they are locked into place by anchor nuts 61 which remain within the panels from the panel fabrication process. The back and side panels 60 and 70 can then be attached to both the top and bottom security bolt boxes 50 and are fixed into place by the attachment bolts which pass through the attachment bolt apertures of the security bolt boxes fixed into place by the attachment nut to form the basic enclosure of the safe. Finally a hinged door can be affixed to the open wall to provide a complete security enclosure. Importantly, the on-site assembly process can be conducted on a ground-up basis. In other words, the bottom panel is positioned in a desired location and then the back and side panels placed thereon and attached thereto. The bottom thereby provides a flat, even work base or foundation. Also, with reference back to FIGS. 1*a* and 1*b*, it can be seen that the top and bottom panels 30 and 40 extends past the side walls 70 and rear wall 60 to optically hide the abutting seams of the vertical panels.

Finally, the inside of the safe can be finished off with a plate 55 that sits on top of upstanding walls 54 of the security bolt box 50. Preferably, such a cover has a depending side wall at one side for covering the forward base seam between the security bolt box and the inner portion 34 or 44 of the top or bottom panel 30 or 40. This cover plate can be screwed down on a bolt box and/or can be hingedly attached to provide for a "secret compartment." Referring now to FIGS. 6*a*, 6*b*, and 6*c*, another embodiment of the modular security safe of the present invention is shown. The modular security safe is generally indicated at 120 and includes a top panel 130, a bottom panel 140, and back and side panels 170. These panels, 130, 140, and 170, the structure of which will be further discussed hereinafter, are interconnected by means of security bolt boxes 150 which attach the panels together to form a safe. Top panel 130 includes an outer portion 132 with an outer surface 133 and an inner portion 134 with an inner face 135. The inner portion 134 is generally smaller than the outer portion 132 in terms of length l and width w. A rabbet face 136 created on the outer portion 132 which, in connection with the perimeter 137 of the inner portion 134, forms a step between the inner portion 134 and the outer portion 132.

Similarly, the bottom panel 140 includes an outer portion 142 with an outer surface 143 and an inner portion 144 with an inner surface 145. The inner portion 144 is generally smaller than the outer portion 142 in terms of length l and width w. A rabbet face 146 is created on the outer portion 142, which in connection with the perimeter 147 of the inner portion 144, forms a step between the inner portion 144 and the outer portion 142.

Attached to the inner surface 135 of the inner portion 134 of the top panel 130 is a security bolt box generally indicated at 150. Likewise, a security bolt box 150 is attached to the inner surface 145 of the inner portion 144 of the bottom panel 140. The security bolt box 150 includes a bottom face 152 and upstanding walls 154 to form a tray like configuration. The upstanding walls 154 can be interconnected with the bottom face 152 or can be formed through a bending and folding operation as previously described. The security bolt box 150 is attached to the inner portion 134 of top panel 130 and inner portion 144 of bottom panel 140 by means of anchor bolts (not shown) which extend through the anchor bolt box apertures 156 in the security bolt box 150. The security bolt box 150 is also provided with attachment bolt apertures 158 extending about the upstanding walls 154 for receiving attachment bolts not shown to attach side and back panels 170 with the top and bottom panels 130 and 140 to form a safe. Importantly, the upstanding side walls 154 of the security bolt box 150 are recessed from the edges of inner portion 144 to provide an exposed portion of the inner surface 145 of inner portion 144 for facilitating interconnection of the top and bottom panels with the side and back panels 170.

The side and back panels 170 include outer portions 172 and inner portions 174. The outer portions 172 include an outer surface 173 and the inner portions 174 includes an inner surface 175. Like the top panel and bottom panel, the inner portions 174 are stepped in relation to the outer portion 172 creating a rabbet face 176 which extends about all four sides of the side and back panels 170. Upper and lower surfaces of inner surfaces 175 of the side and back panels 170 include apertures for receiving attachment bolts (not shown) that extend through the security bolt boxes 150 to join the side walls 170, back wall 170 and top and bottom panels 130 and 140.

Front panel 121 is constructed similarly to side and pack panels 170 with an outer portion and a stepped down inner portion along all edges of the outer portion. The front panel 121 can be hingedly attached to one side wall 170.

Figure 6A:
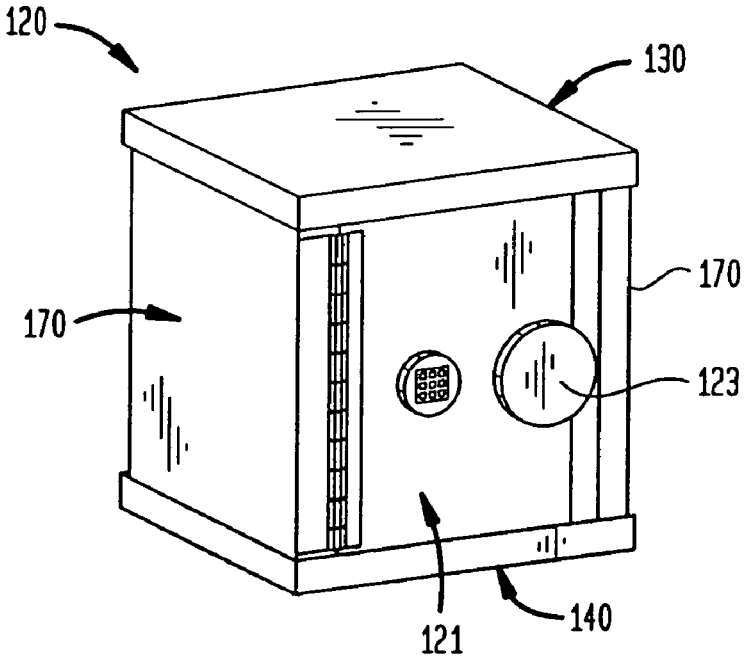
FIG. 6*a* is an alternate perspective view of the modular security safe of the present invention shown in an assembled form.
Figure 6B:
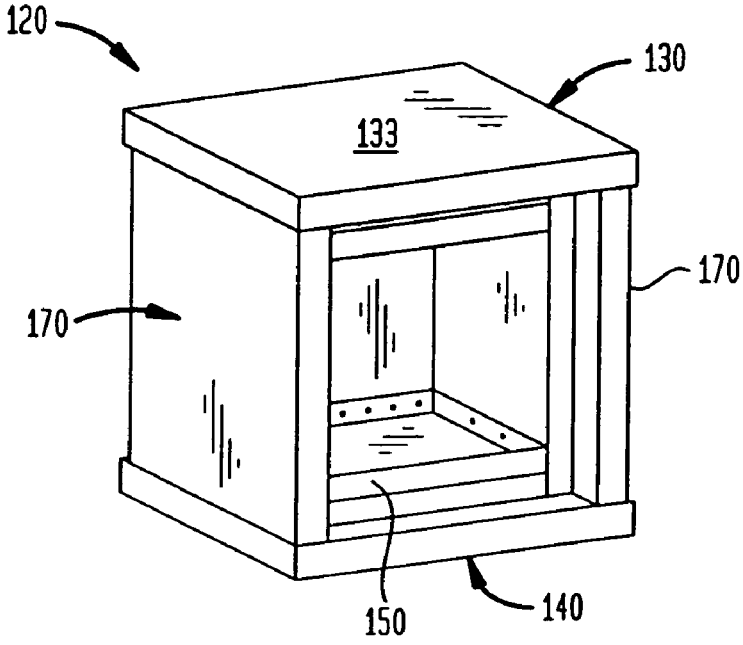
FIG. 6*b* is a perspective view of the apparatus of FIG. 6*a* with the door of the safe removed.
Figure 6C:
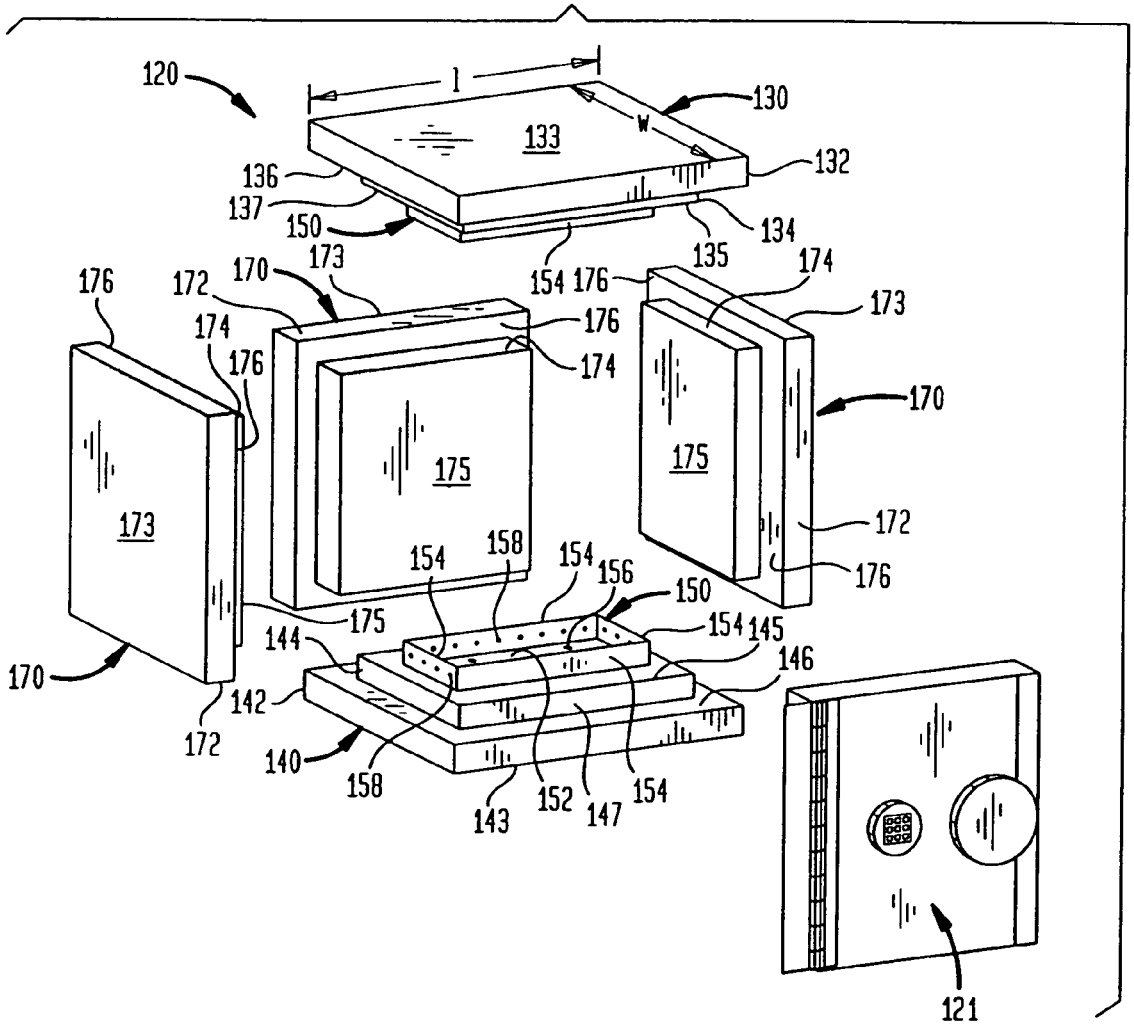
FIG. 6*c* is an exploded perspective view of the apparatus of FIG. 6*a;*

The panels shown in FIGS. 6*a*–6*c* can be constructed in the same manner as previously disclosed herein.

Figure 7A:
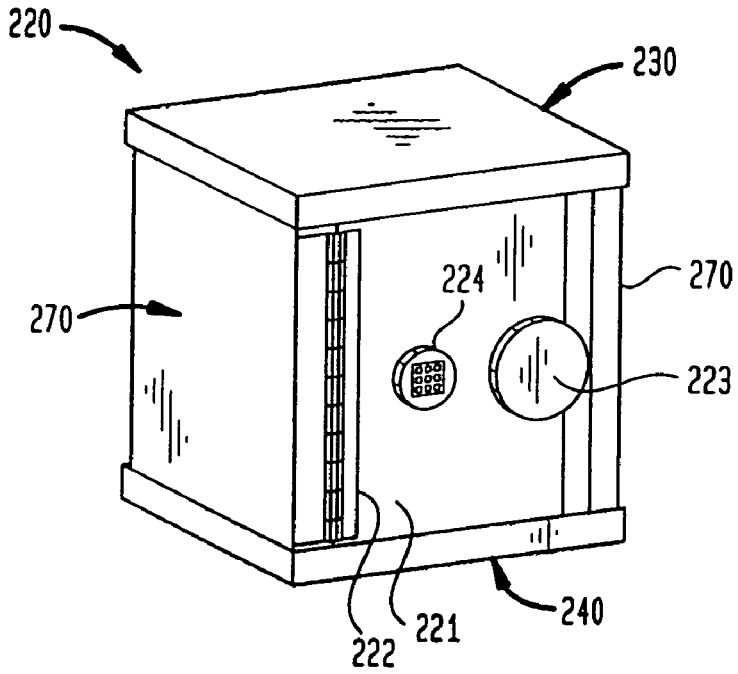
FIG. 7*a* is a perspective view of an alternate embodiment of the modular safe of the present invention in assembled form.
Figure 7B:
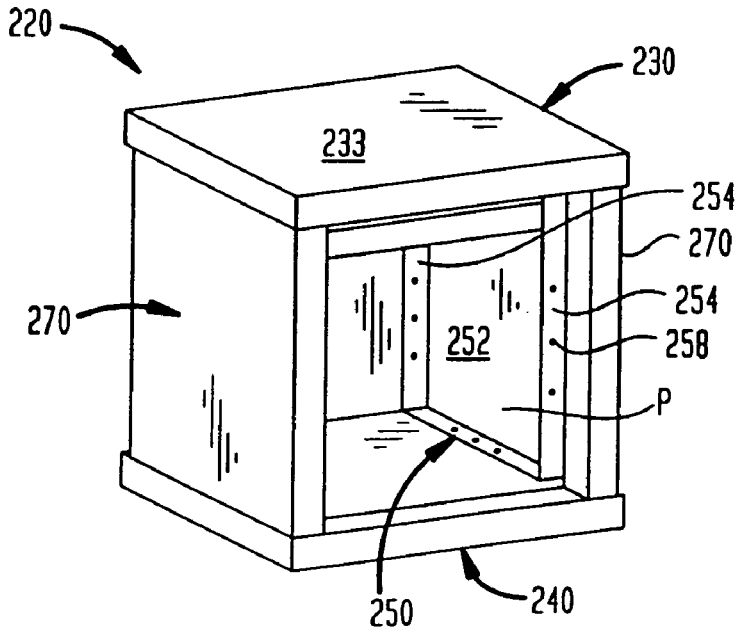
FIG. 7*b* is a perspective view of the apparatus shown in FIG. 7*a* with the door of the safe removed.
Figure 7C:
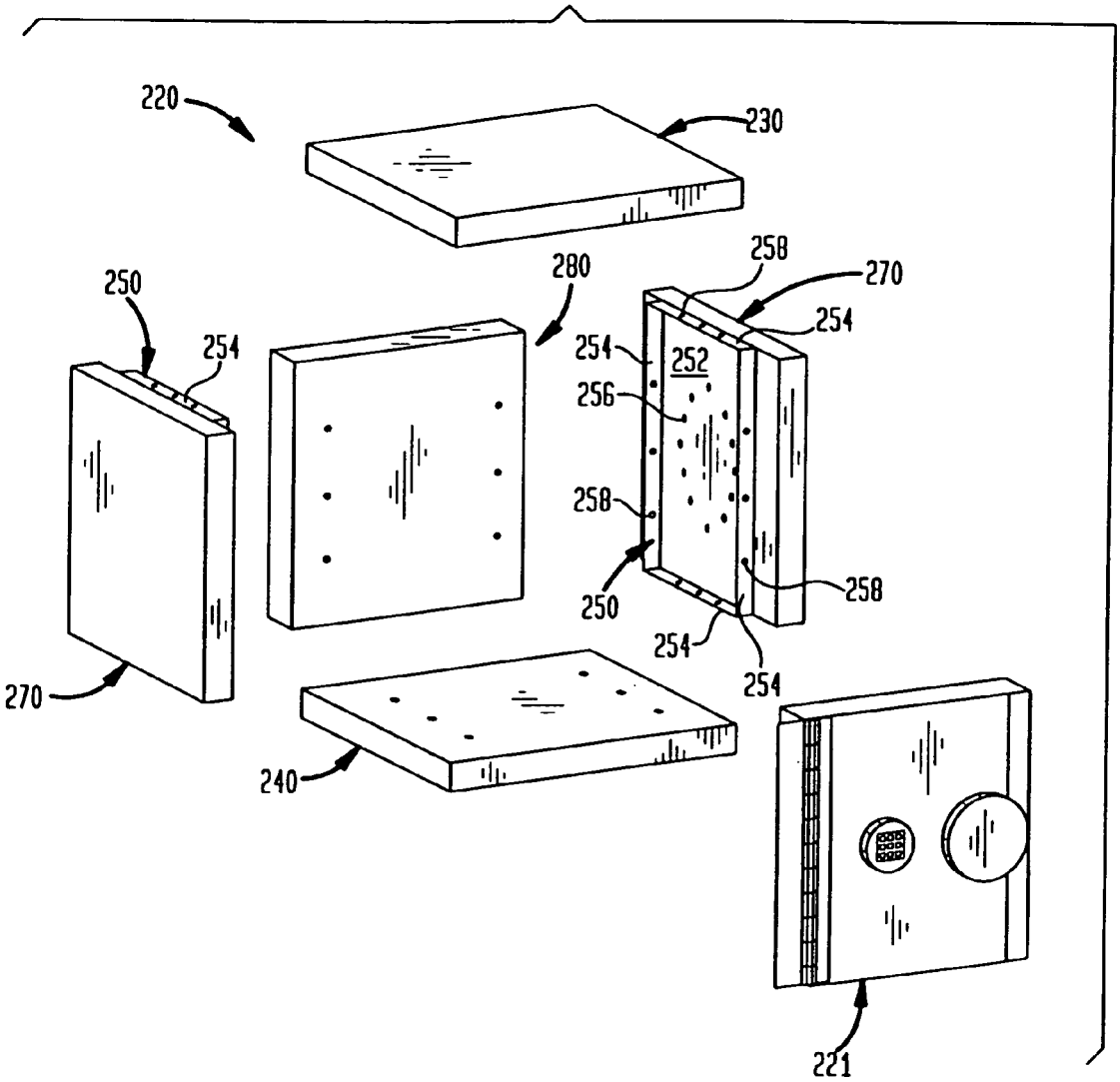
FIG. 7*c* is an exploded perspective view of the apparatus of FIG. 7*a;*

Referring now to FIGS. 7*a*–7*c*, another embodiment of the modular security safe of the present invention is shown. The modular security safe generally indicated at 220 and includes a top panel 230, a bottom panel 240, back panel 280 and side panels 270. These panels 230, 240, 270, and 280, the structure of which will be further discussed hereinafter, are interconnected by a means of security bolt boxes 250 which attach the panels together to form a safe. Each of the panels 230, 240, 270, and 280 include an outer face and an inner face. Opposing side panels 270 have security bolt boxes 250 attached thereto. The security bolt boxes 250 include bottom faces 252 and upstanding walls 254 to form a tray-like configuration. The upstanding panels 254 can be interconnected with the bottom face 252 or can be formed by a bending and forming operation as previously described. The opposing side panels 270 by means of anchor bolts (not shown) which extend through anchor bolt box apertures 256 provide with attachment bolt apertures 258 extending through the upstanding walls 254 for receiving attachment bolts (not shown) to attach opposing side panels 270 with top and bottom panels 230, 240 and back panel 280 to form a safe. Importantly, the upstanding side panels 254 of the security bolt box 250 are recessed from the forward and rearward edges of opposing side panels 270 to allow for positioning of rear panel 280 and front panel 121. The security bolt boxes 250 are flush with the upper and lower edges of the opposing side panels 270. The opposing side panels 270 as well as back panel 280 sit on bottom panel 240. Likewise, top panel 230 sits on top of opposing side panels 270 and back panel 280. The front panel 221 can be hingedly attached to one side panel 270.

The panels shown in FIGS. 6*a*–6*c* can be constructed in the same manner as previously disclosed herein.

Figure 8:
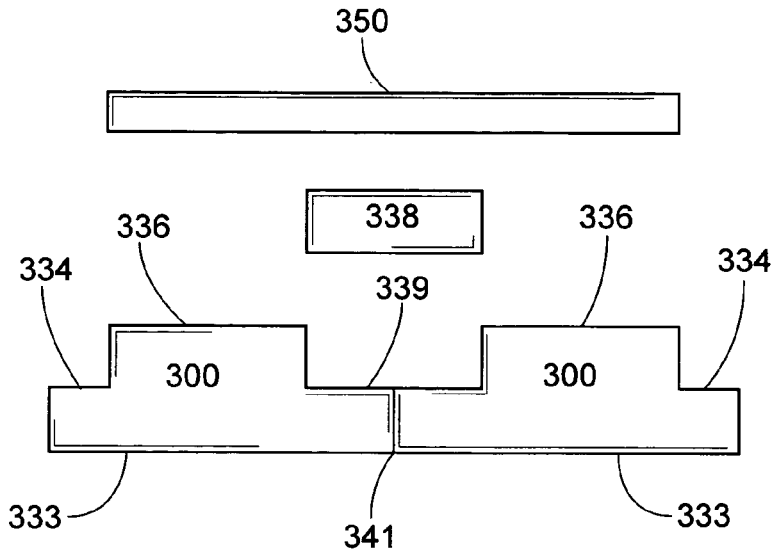

FIG. 8 is a side view of two panels 300 positioned adjacent each other, each panel includes an outer surface 333 and an inner surface 334, the inner surface 334 having a rabbet face 336. These panels are identical to those illustrated in FIG. 6*c*. In the embodiments heretofore discussed, one panel 300 would be used to form the bottom of a safe, and one panel each would be used to form the side panels of a safe with another identical panel 300 being used to form the upper wall of the safe. The remaining open wall would accept a mounted pivotal door allowing access to the safe. In this further embodiment, such a safe as that illustrated in FIG. 6*c* may be expanded using identical panels in addition to a reconfigured security bolt box and a filler block.

In FIG. 8, the two panels 300 are positioned adjacent each other, each having an identical interior rabbetted face 336. A filler block 338 is dimensioned to snugly fit between the slotted gap 339 between the two rabbetted faces 336. Filler block 338 is constructed in the same manner as panels 300 as heretofore previously discussed. A security bolt box 350 would then be secured to the two adjacent panels 300, the security bolt box spanning the rabbetted faces 336 and the filler block 338 maintaining the filler block in position. In this configuration it can be seen that the seam 341 between adjacent panels 300 is not continuous from the exterior surface 333 of adjacent panels 300 to the interior of the safe. The filler block 338 serves to block the seam and prevents a would be safe cracker or robber from using such seam 341 as a means of ingress into the safe.

Figure 9:
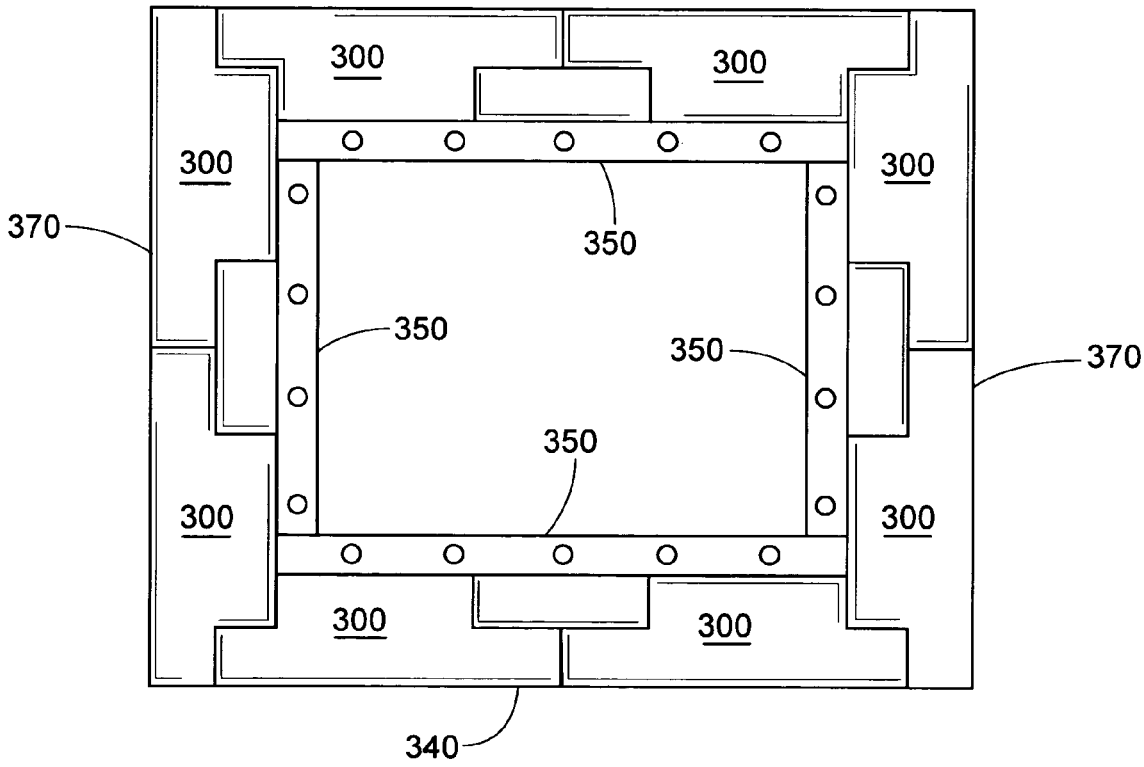

FIG. 9 is a cross sectional view of the safe 120 as illustrated in FIG. 6*c* wherein Applicant's expandability capability has increased the volume of the safe by a factor of 4. FIG. 9 presents a cross sectional view for better understanding. In FIG. 9, a series of identical panels 300 have been juxtaposed adjacent each other such that two panels 300 form the base 340 of the safe, two juxtaposed panels 300 form one side 370 of the safe, two juxtaposed panels 300 form the opposing side 370 of the safe and two juxtaposed panels 300 form the upper surface of the safe. In each instance, a filler block 338 is fit within the slot 339 formed by adjacent rabbetted surfaces 336 of adjacent panels 300 thereby interrupting and blocking the seam 341 formed between such adjacent panels 300. A security bolt box 350 is then secured to the bottom, sides and top walls of the interior surface of the panels formed by the rabbetted face and the filler block and secured in place. In this manner, the security bolt box 350 secures the panels 300 and the filler block 338.

In the cross section illustrated in FIG. 9, the depth of the safe, similar to that illustrated in FIG. 6*c* has not been increased, rather the width and the height have been doubled to increase the volume of the safe by a factor of four. The rear wall would be assembled in the same manner as that described with respect to the bottom, top and side walls with the understanding that four panels 300 and associated filler blocks 338 would be required to provide a continuous rear wall with the side, top and bottom walls illustrated. The same would hold true for the front wall (not shown) and the incorporation in the front wall of a door means, hinge, handle and combination lock as illustrated in FIG. 6*c*.

Figure 10:
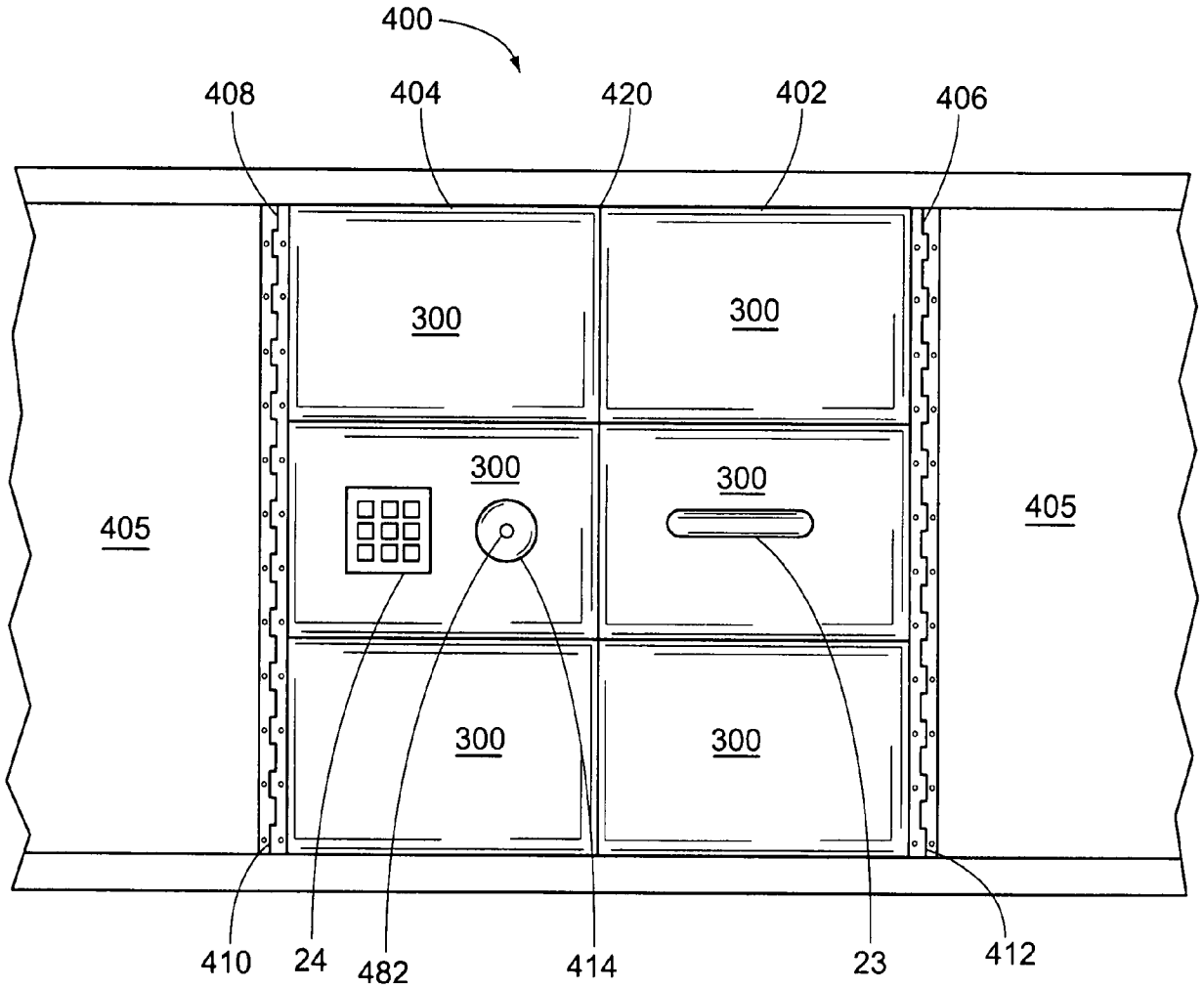
FIG. 10 is a front view of a double door to be utilized with a safe, vault or bunker.

Applicant's development of a manner in which to secure a double door safe, vault or bunker constructed of Applicant's modular panels or for conventional double door assemblies for safes, vaults or bunkers is first illustrated in FIG. 10 which is a front view of a double door 400 for a safe, vault or bunker. Double door 400 comprises a first door 402 and a second door 404, the doors being mounted adjacent each other in the wall 405 of a safe, vault or bunker. In the double door 400 illustrated in FIG. 10, the double doors 402 and 404 are formed by a plurality of panels 300 as described heretofore which allows for the construction of a safe, vault or bunker and concomitant doors thereof in situ. The doors are mounted at their outer edges 406 and 408 by hinge means 410 and 412 which would preferably be in the form of a piano hinge which extended the height of the double door 400. Secured into one of the double doors would be a combination lock or keypad 24 of conventional construction which would engage or disengage a lock engaging member on the interior of said door, a handle means 23 as provided on the modular safes previously discussed, and a throw bolt wheel 414 which secures the first door 402 and the second door 404 in a locked and secured position and which allows for the unlocking of the first door and second door 402 and 404 respectively.

Figure 11:
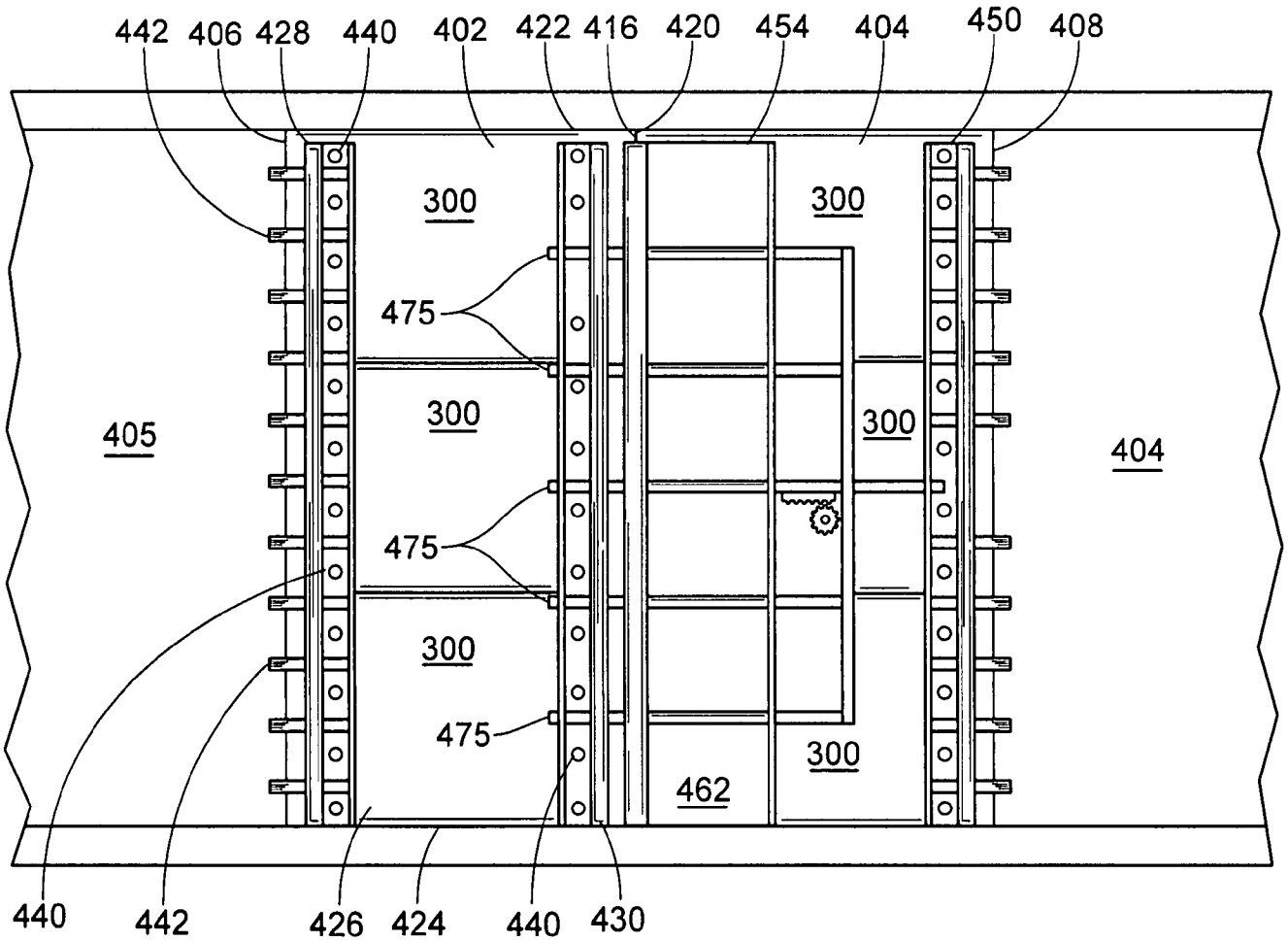
FIG. 11 is a rear locked view of a double door to be used with a safe, vault or bunker.
Figure 12:
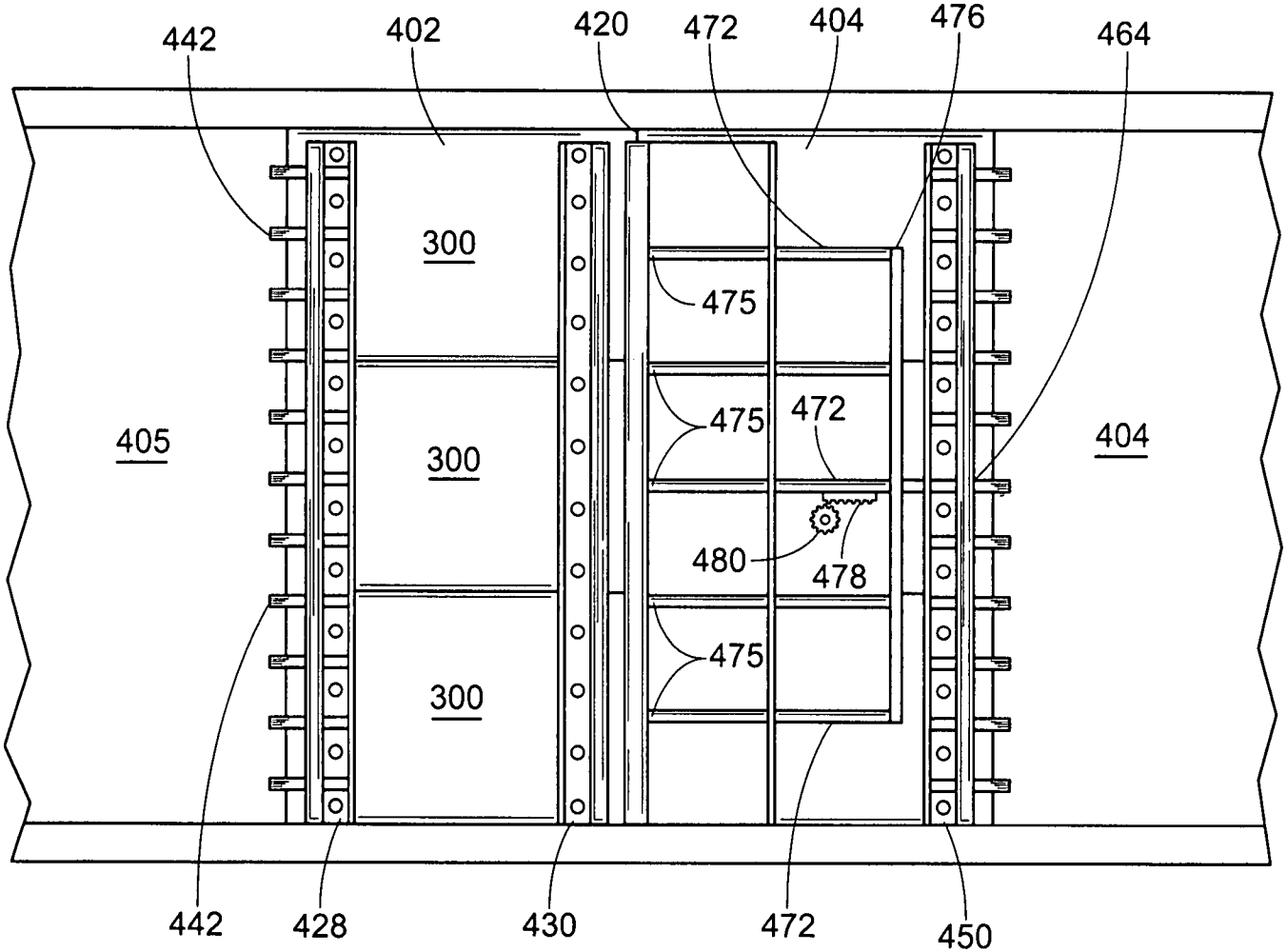
FIG. 12 is a rear view of an unlocked double door to be utilized with a safe, vault or bunker.

FIG. 11 is a rear view of the double door 400 as viewed from the interior of the safe, vault or bunker. First door 402 and second door 404 are defined by an outer edge 406 and 408 where the doors are hingeably mounted to the wall 405 of the safe, vault or bunker. The inner edges of the door 416 and 418 meet at seam 420 which bisects double door 400 from the upper edge 422 to the lower edge 424.

Figure 14:
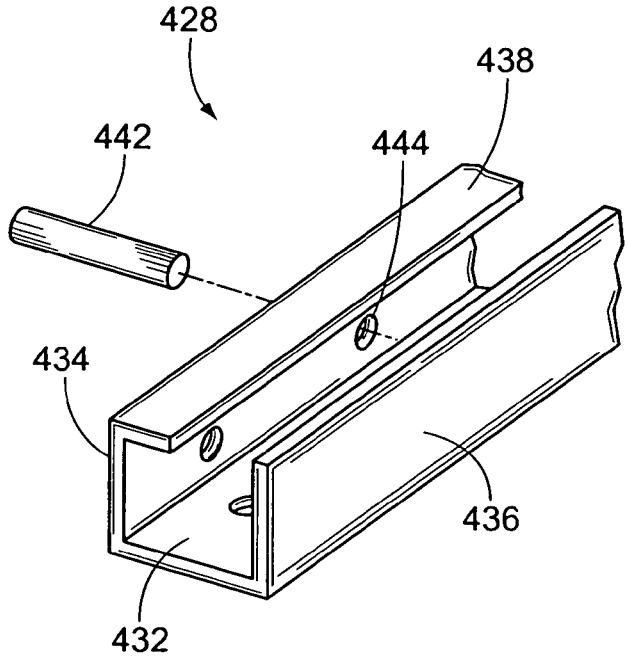
FIG. 14 is a partial perspective view of one type of the C-shaped bolt channels utilized.

Mounted on the rear surface 426 of first door 402 is a first longitudinal bolt channel 428 and a second longitudinal bolt channel 430. First and second longitudinal bolt channels 428 and 430 are C-shaped sections as illustrated in FIG. 14. The C-shaped sections comprise an elongated planar base web 432 with two perpendicular side walls 434 and 436 depending from the same side of the elongated planar base web 432. One of the perpendicular side walls, 434, has a planar horizontal lip 438 parallel with the elongate planar base web 432 and oriented towards the opposing side wall 436.

First longitudinal bolt channel 428 is positioned proximate to the vertical outer edge 406 of first door 402 with lip member 438 oriented so that it is extending towards the seam 420 formed between first door 402 and second door 404.

Second longitudinal member 430 is positioned along the inner edge 416 of first door 402 which is the seam 420 formed between first door 402 and second door 404 with its lip member oriented towards the outer edge 406 of first door 402. First and second longitudinal bolt channels 428 and 430 are secured to the inner surface 426 of first door 402 by a plurality of threaded fasteners or bolts 440 which are secured through elongated planar base web 432 into the panels 300 forming first door 402.

First longitudinal bolt channel 428 has a plurality of fixed rods 442 or deadbolts secured to perpendicular side wall 436 and extending through apertures 444 in opposing perpendicular side wall 434, the rods 442 or deadbolts extending beyond the outer edge 406 of first door 402.

Second door 404 has a similar C-shaped first longitudinal bolt channel 450 positioned along its outer edge 408 with identical fixed rods 442 or dead bolts exending beyond the outer edge 408 of second door 404. First longitudinal bolt channel 450 of second door 404 also has a plurality of apertures in perpendicular side wall 436 for receipt of movable throw bolts described hereafter when the door is in an unlocked and open position. First longitudinal bolt channel 450 of second door 404 is secured to second door 404 in a manner similar to that described with the longitudinal bolt channels of door 402.

Figure 15:
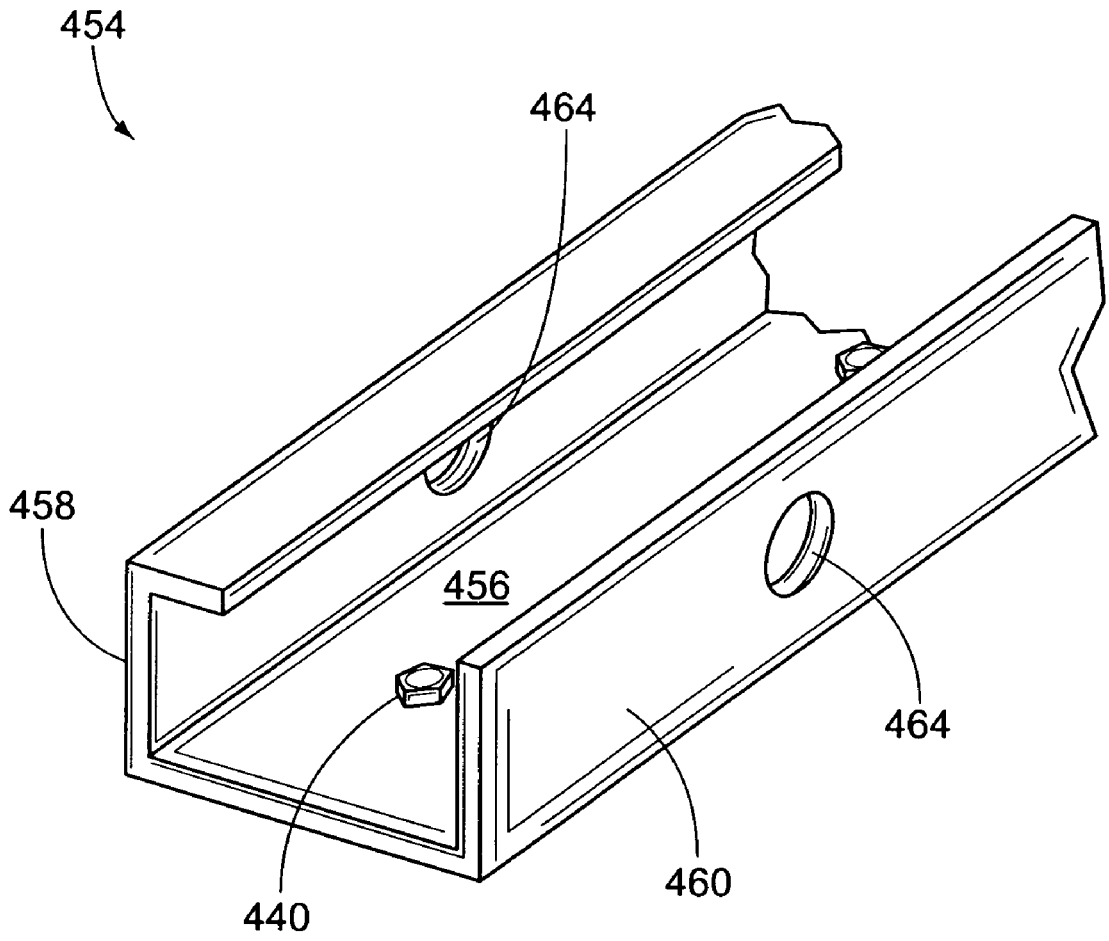
FIG. 15 is a partial perspective view of a second type of C-shaped bolt channel utilized.

Second door 404 has a second C-shaped longitudinal bolt channel 454 (FIG. 15) having a planar base web member 456, two perpendicular side walls 458 and 460 extending to the same side of elongated planar base web 456, however, second C-shaped bolt channel 454 of door 404 has a wider base web than longitudinal C-shaped bolt channels 428, 430, and 450. Second C-shaped bolt channel 454 of door 404 is secured to the rear face 462 of door 404 in a manner similar to the other C-shaped bolt channels 423, 430, and 450, however, second C-shaped bolt channel 454 of door 404 overlaps the seam 420 between doors 402 and 404.

Perpendicular side walls 458 and 460 of second C-shaped bolt channel 454 of door 404 has at least one aligned aperture guide 464 formed therein for the passage of movable throw bolts as described hereafter.

Figure 13:
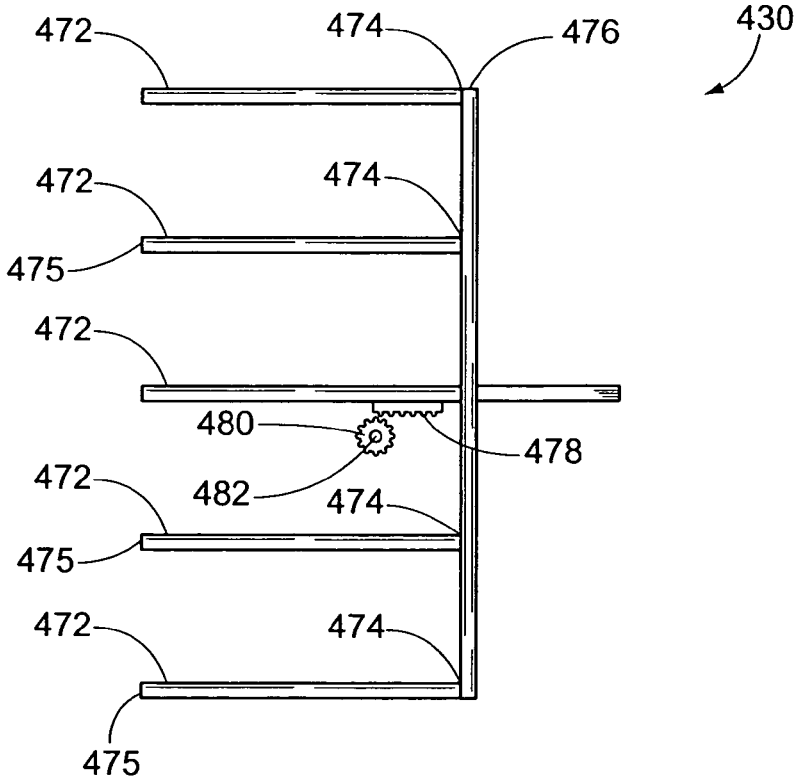
FIG. 13 is a front view of the locking mechanism or movable throw bars associated with the locking mechanism.

FIG. 13 is a front planar view of the locking mechanism 430 which comprises a plurality of rod-shaped, horizontal throw bolts 472, each of the rod-shaped, horizontal throw bolts 472 having a first end 474 being secured to a vertical throw bolt support bar 476. At least one of the throw bolts 472 extends beyond support bar 476 and is engageable within an aperture of C-shaped channel. On the underside of at least one of the throw bolts 472 would be mounted a linear toothed gear 478 cooperative with a rotatable round toothed gear 480 mounted on door 404 between second C-shaped bolt channel 454 of door 404 and first C-shaped bolt channel 450 of door 404. Round toothed gear 480 is mounted on a shaft 482 of the interior of door 404 which shaft extends through door 404 to the exterior of door 404 and on which is mounted the throw bolt wheel 414. A lock engaging member actuable from said keypad 24 allows for the rotation or non-rotation of gear 480.

In operation, with the double door 400 closed and in a locked position, one seeking entry into the safe, vault or bunker, would enter in the appropriate combination or code on the keypad 24. The entering of the proper code or combination would cause a releasing mechanism to become unlocked on the interior surface of the double door opposite the throw bolt wheel 414. The user would then rotate the throw bolt wheel 414 which in turn would engage linear toothed gear 478 on one of the throw bolts 472 by means of rounded tooth gear 480 such that all of the horizontal throw bolts 472 and support bar 476 would move away from seam 420 of double door 400 and become disengaged from second longitudinal bolt channel 430 on first door 402 and be withdrawn such that second end 475 of horizontal throw bolts 472 are positioned within second longitudinal C-shaped bolt channel 454 of second door 404. The user would then engage the handle means 23 on first door 402 to open first door 402 and subsequently open second door 404 allowing access to the safe, vault or bunker through the opened double doors. In closing and securing the safe, vault or bunker, the aforementioned steps would be taken in reverse. First, door 404 would be closed and then door 402 would then be closed. The user would then engage the throw bolt wheel 414 and rotate it so that the horizontal throw bolts 472 would again extend through second C-shaped longitudinal bolt channel 454 of door 404, across seam 420 formed between door 404 and door 402 and into second longitudinal C-shaped channel 430 on door 402. The user would then enter an appropriate code on the keypad 24 which would again engage the locking device on the interior of door 404. The horizontal throw bolts 472 are now in a locked engaging position and access to the safe, vault or bunker cannot be had without proceeding with the opening process as heretofore described.

This assembly illustrated allows for a minimum of four contact points for securing the double doors in a locked and secure position. Four contact points eliminate rattle in the doors by allowing more contact point pressure. The number of contact points can be increased by increasing the number of bolt channels on door 402. The concomitant increase in number of bolt channels would require an increase in the length of the throw bolts and this would only be limited by the width of the door which would dictate the amount of room available for the throw bolt mechanism when the door was in the unlocked or unsecure position. It eliminates the need as required by the prior art for their to be vertical throw bolts on the interior of the double doors such that one of the doors could be opened, but the second door could not be opened until the user had reached inside and released the vertical throw bolts from their locked and secured position. The current assembly provides for security of the safe, vault of bunker with less mechanical operation. Still further, the securing means disclosed herein, allows for a safe, vault or bunker having a double door, to be erected or fabricated in situ because of the use of modular panels and the modularity of the locking mechanism. Still further, the locking and securing mechanism as disclosed herein can have application to a double door utilized in a safe vault or bunker of conventional construction, e.g. not of modular panels, without departing from the spirit and scope of the invention.

Figure 16:
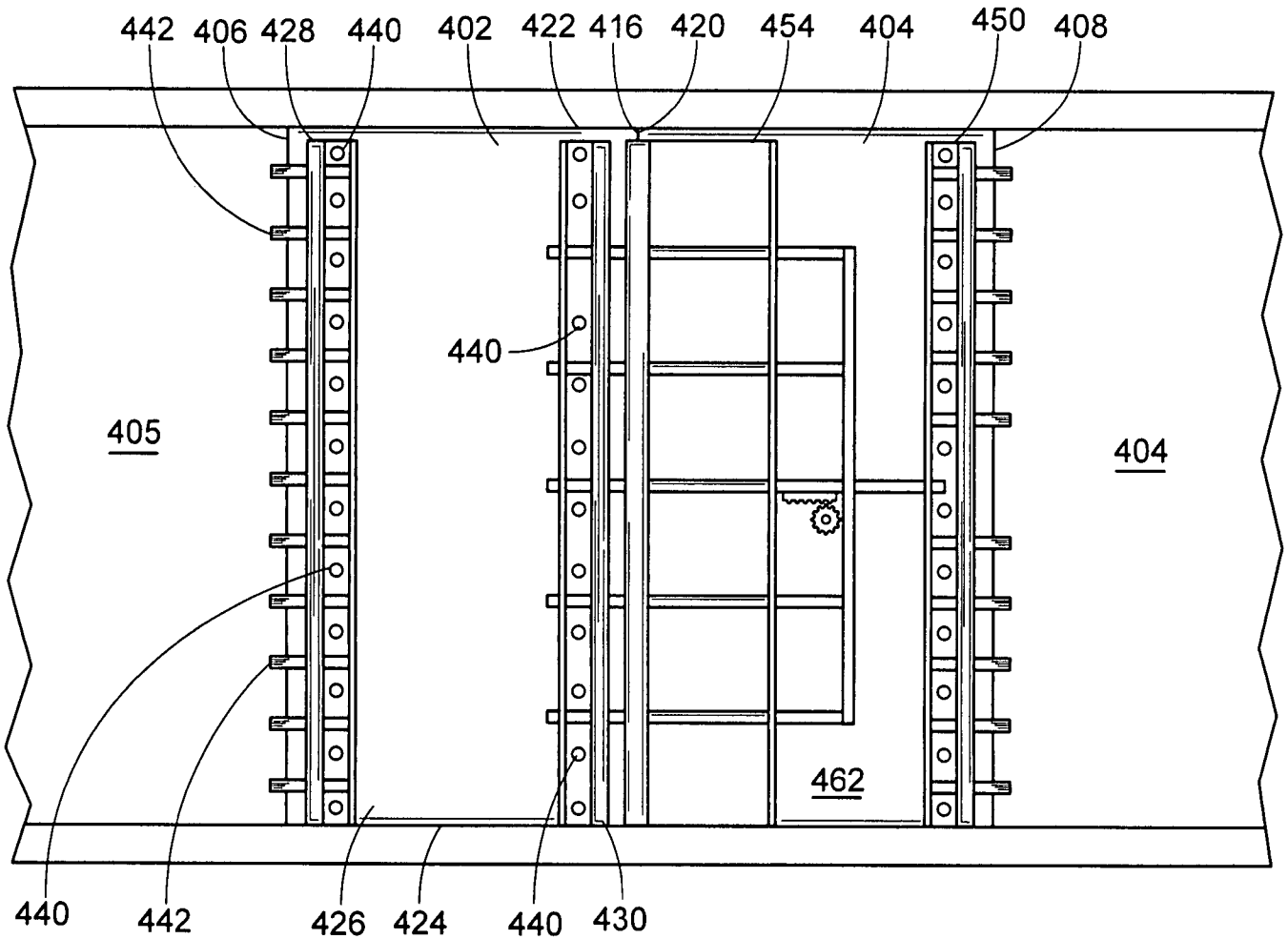
FIG. 16 is a rear view of a double door for use in a safe, vault or bunker in which the double door is constructed by conventional means without the use of modular panels.

FIG. 16 is an inside view of a double door of conventional construction and not fabricated from the Applicant's proprietary panels. The locking mechanism would be installed in the same manner and operate in the same fashion as heretofore described.

While the present invention has been described with respect to the exemplary embodiments thereof, it will be recognized by those of ordinary skill in the art that many modifications or changes can be achieved without departing from the spirit and scope of the invention. Therefore it is manifestly intended that the invention be limited only by the scope of the claims and the equivalence thereof.

I claim:

1. A security and locking mechanism for a double door utilized in a security safe, vault or bunker, said security and locking mechanism comprising:

a security safe, vault or bunker having a plurality of interconnected side walls, a top wall interconnected with said side walls, and a bottom wall interconnected with said side walls, there being formed on one of said side walls an outward opening double door for ingress and egress into said security safe, vault or bunker, said double door being secured by a security and locking mechanism, said double door comprising a first door and a second door hinged to one of said side walls along one vertical longitudinal edge, an opposing vertical longitudinal edge of said first door and said second door in abutting relationship to each other when in a closed position forming a seam between said doors, said doors having an interior surface and an exterior surface;

a keypad or combination member mounted on said exterior surface of said first door;

a rotatable handle member mounted on said exterior on said first door, said rotatable handle member in communication with a rotatable gear member mounted on a common spindle with said rotatable handle member on said interior surface of said first door, said rotatable gear member in communication with a linear gear member mounted on said security and locking mechanism on said interior of said first door, said rotatable handle member rotatable in response to correct combination being entered on said keypad or said combination member;

a lever handle member mounted on the exterior of one of said first or second doors for the hingeable opening and closing of said double door;

a plurality of vertically oriented first bolt channels secured to said interior surface of said first and second doors, proximate said hinged vertical longitudinal edge, said bolt channels proximate said hinged vertical longitudinal edge having fixedly secured thereto a plurality of horizontally disposed fixed security bolts extending in a plane parallel to said door and extending beyond said hinged vertical longitudinal edge so as to overlap an inner wall of said security safe, vault or bunker;

a second bolt channel fixedly vertically oriented and secured to the inner surface of said second door proximate said seam formed by said first and second doors when in a closed position, said second bolt channel having a plurality of horizontal aligned apertures there through;

a third bolt channel vertically oriented and fixably secured to the inner surface of said first door, said third bolt channel overlapping said seam formed between said first and second doors, said third bolt channel having a plurality of horizontal aligned apertures there through in alignment with said apertures in said second bolt channel;

a horizontally movable throw bolt support bar having a vertical orientation and positioned between said first bolt channel and said third bolt channel on said first door, and having a plurality of throw bolts fixedly mounted thereon and extending to one side thereof horizontally, said throw bolts alignable with apertures formed in said second bolt channel and said third bolt channel mounted proximate said seam of said first and second doors, one of said throw bolts extending to an opposing side of said throw bolt support bar and engageable in an alignable aperture formed in said first bolt channel proximate said hinged vertical edge on said first door;

one of said throw bolts having secured thereon, said linear gear member in communication with said rotatable gear for movement of said throw bolt support bar and secured throw bolts from a closed locked position wherein said throw bolts extend through said second and third bolt channels to an open position wherein said throw bolts are withdrawn such that said throw bolts do not extend beyond said seam of said doors into engagement with said second bolt channel.

2. A security and locking mechanism in accordance with claim 1 wherein said first bolt channels are generally C-shaped in cross section having a planar web member having a plurality of apertures there through for the receipt of a securing means for securing said first bolt channels to said interior surface of said first and second doors, said planar web member having upstanding flanges on longitudinal edges thereof extending on the same side of the planar web member.

3. A security and locking mechanism in accordance with claim 1 wherein said second and third bolt channels are generally C-shaped in cross section having a planar web member having a plurality of apertures therethrough for the receipt of a securing means for securing said bolt channel to said interior surface of said doors, said planar web member having upstanding flanges on longitudinal edges thereof extending to the same side of the planar web member, said upstanding flanges having a plurality of aligned apertures therethrough for the slidable receipt of said horizontally movable throw bolts.

4. A security and locking mechanism in accordance with claim 3 wherein the diameter of said apertures in said bolt channels for receipt of said horizontally movable throw bolts is equal to the diameter of said throw bolts.

5. The security and locking mechanism in accordance with claim 1 wherein said vertically oriented second bolt channel proximate said seam between said first and second doors and said third bolt channel overlapping said seam between said first and second doors provides for four contact points for said movable throw bolts when in a locked and secured position.

6. The security and locking mechanism in accordance with claim 5 wherein the addition of additional second bolt channels proximate said second bolt channel proximate said seam between said first and second doors increases the number of said contact points for said horizontally movable throw bolts for securing said doors in a closed and locked position.

7. The security and locking mechanism in accordance with claim 1 wherein first and second doors comprising said double door for said security safe, vault or bunker, are of conventional one piece construction.

8. The security and locking mechanism in accordance with claim 1 wherein first and second doors comprising said double door for said security safe, vault or bunker, are of modular construction formed by a series of panels whose integrity is maintained by said bolt channels.

* * * * *